US010290959B2

(12) United States Patent
Kumakura et al.

(10) Patent No.: US 10,290,959 B2
(45) Date of Patent: May 14, 2019

(54) CABLE MOUNTING SUBSTRATE, CABLE-EQUIPPED SUBSTRATE AND METHOD FOR CONNECTING CABLES TO CABLE MOUNTING SUBSTRATE

(71) Applicant: Hitachi Metals, Ltd., Tokyo (JP)

(72) Inventors: Takashi Kumakura, Tokyo (JP); Hideharu Nagai, Tokyo (JP)

(73) Assignee: Hitachi Metals, Ltd., Tokyo (JP)

( * ) Notice: Subject to any disclaimer, the term of this patent is extended or adjusted under 35 U.S.C. 154(b) by 0 days.

(21) Appl. No.: 15/893,788

(22) Filed: Feb. 12, 2018

(65) Prior Publication Data

US 2018/0248279 A1 Aug. 30, 2018

(30) Foreign Application Priority Data

Feb. 24, 2017 (JP) ..... 2017-034133

(51) Int. Cl.

| | |
|---|---|
| ***H01R 9/05*** | (2006.01) |
| ***H01R 43/02*** | (2006.01) |
| ***H01B 7/02*** | (2006.01) |
| ***H01R 9/03*** | (2006.01) |
| ***H01R 12/53*** | (2011.01) |

(52) U.S. Cl.

CPC ..... *H01R 9/0515* (2013.01); *H01B 7/02* (2013.01); *H01R 9/035* (2013.01); *H01R 12/53* (2013.01); *H01R 43/0256* (2013.01)

(58) Field of Classification Search

CPC ..... H01R 9/0515; H01R 43/0256; H01B 7/02

USPC ..... 174/74 R

See application file for complete search history.

(56) References Cited

U.S. PATENT DOCUMENTS

| | | | | |
|---|---|---|---|---|
| 2007/0181337 | A1* | 8/2007 | Miller | H01R 9/0515 174/261 |
| 2009/0068884 | A1* | 3/2009 | Kim | H01R 9/0515 439/578 |
| 2015/0236431 | A1* | 8/2015 | Schmalbuch | H01R 4/187 174/252 |
| 2017/0133798 | A1* | 5/2017 | Kim | H02G 15/08 |

FOREIGN PATENT DOCUMENTS

| | | | |
|---|---|---|---|
| JP | 2014-089902 | A | 5/2014 |
| JP | 2014089902 | A * | 5/2014 |

* cited by examiner

*Primary Examiner* — Timothy J Thompson
*Assistant Examiner* — Charles Pizzuto
(74) *Attorney, Agent, or Firm* — Scully, Scott, Murphy & Presser, PC

(57) ABSTRACT

Provided is a cable mounting substrate for mounting plural cables each of which includes a center conductor, an insulation covering the center conductor and an outer conductor covering the insulation. The cable mounting substrate includes a plate-shaped base, a ground pattern that is arranged on the base and electrically connected to the outer conductor, and a solder member that is provided on the ground pattern and is melted to electrically connect and fix the outer conductor to the ground pattern. The solder member includes a recessed portion having a shape along an outer shape of the outer conductor.

7 Claims, 9 Drawing Sheets

CABLE MOUNTING SUBSTRATE, CABLE-EQUIPPED SUBSTRATE AND METHOD FOR CONNECTING CABLES TO CABLE MOUNTING SUBSTRATE

The present application is based on Japanese patent application No. 2017-034133 filed on Feb. 24, 2017, the entire contents of which are incorporated herein by reference.

BACKGROUND OF THE INVENTION

1. Field of the Invention

The invention relates to a cable mounting substrate, a cable-equipped substrate, and a method for connecting cables to the cable mounting substrate.

2. Description of the Related Art

Communication devices or electronic devices are connected to each other through cables to transmit and receive signals therebetween. Many cables are provided with a center conductor, an insulation covering the center conductor and an outer conductor covering the insulation. This type of cable also includes differential signal transmission cables having a pair of center conductors.

Such cables are sometimes connected to a substrate on which a communication semiconductor chip, etc. is mounted. For example, cables arranged in parallel may be soldered to a common substrate. In this case, the center conductor and the outer conductor are exposed at an end of each cable. Each cable is arranged such that the exposed center conductor is soldered to a connection pad formed on a surface of the substrate and the outer conductor is soldered to a ground pattern formed on the surface of the substrate. The connection pads connected to the center conductors and the metal layer connected to the outer conductors are formed on the same surface of the substrate but are electrically isolated.

Related arts to the invention may include JP 2014/89902 A.

SUMMARY OF THE INVENTION

Cables used for telecommunications are very thin and, in many cases, a diameter of cable is about 1 mm to 3 mm. Thus, it is not easy to solder plural non-parallel cables to the respective predetermined positions on the substrate. Particularly, it is not easy to appropriately bring a tip of soldering iron into contact with each outer conductor since a distance between the outer conductors of adjacent cables is small. If the tip of soldering iron is not appropriately brought into contact with the outer conductor, heat is not sufficiently transmitted to the outer conductor and solder is not melted sufficiently. In addition, when pressing the tip of soldering iron too hard against the outer conductor, the insulation located inside the outer conductor is deformed due to heat and pressure.

It is an object of the invention to provide a cable mounting substrate that allows plural cables to be easily and reliably connected to predetermined positions, as well as a cable-equipped substrate and a method for connecting cables to the cable mounting substrate.

According to an embodiment of the invention, a cable mounting substrate for mounting a plurality of cables each of which comprises a center conductor, an insulation covering the center conductor and an outer conductor covering the insulation comprises:

a plate-shaped base;

a ground pattern that is arranged on the base and electrically connected to the outer conductor; and a solder member that is provided on the ground pattern and is melted to electrically connect and fix the outer conductor to the ground pattern, wherein the solder member comprises a recessed portion having a shape along an outer shape of the outer conductor.

Effects of the Invention

According to an embodiment of the invention, a cable mounting substrate can be provided that allows plural cables to be easily and reliably connected to predetermined positions, as well as a cable-equipped substrate and a method for connecting cables to the cable mounting substrate.

BRIEF DESCRIPTION OF THE DRAWINGS

Next, the present invention will be explained in more detail in conjunction with appended drawings, wherein.

DETAILED DESCRIPTION OF THE PREFERRED EMBODIMENTS

First Embodiment

Figure 1A:
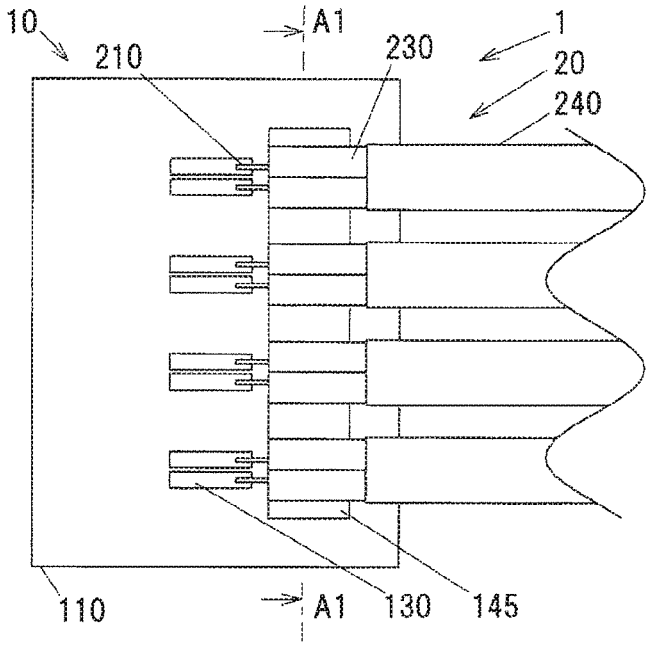
FIG. 1A is a plan view showing a cable-equipped substrate in the first embodiment of the present invention.
Figure 1B:
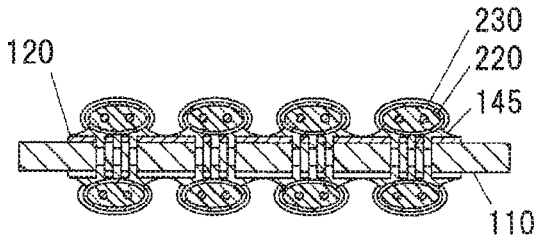
FIG. 1B is a cross sectional view taken along a line A1-A1 in FIG. 1A.
Figure 2A:
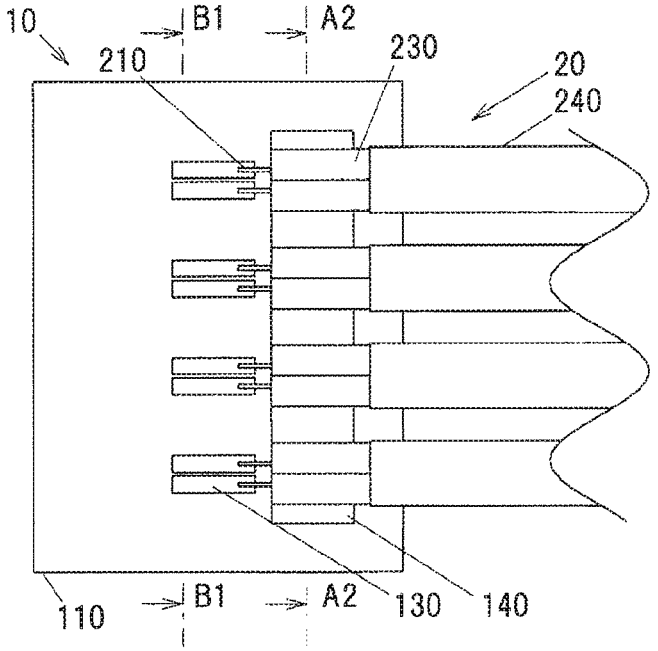
FIG. 2A is a plan view showing a cable mounting substrate before cables are connected.
Figure 2B:
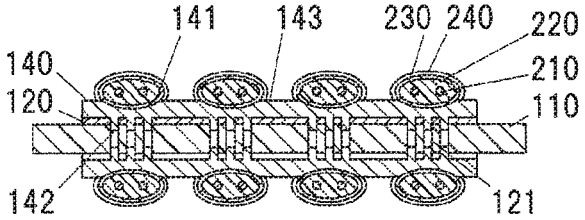
FIG. 2B is a cross sectional view taken along a line A2-A2 in FIG. 2A.
Figure 2C:
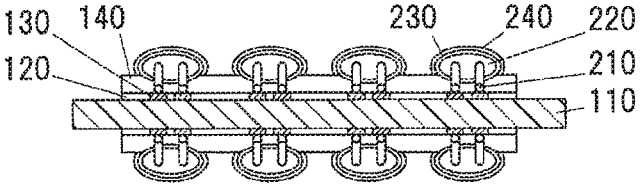
FIG. 2C is a cross sectional view taken along a line B1-B1 in FIG. 2A.

The first embodiment of the invention will be described in reference to FIGS. 1A, 1B and 2A to 2C. FIG. 1A is a plan view showing a cable-equipped substrate 1 in the first embodiment of the invention. FIG. 1B is a cross sectional view taken along the line A1-A1 in FIG. 1A. FIG. 2A is a plan view showing a cable mounting substrate 10 before cables 20 are connected (soldered). FIG. 2B is a cross sectional view taken along the line A2-A2 in FIG. 2A. FIG. 2C is a cross sectional view taken along the line B1-B1 in FIG. 2A.

Cable-Equipped Substrate 1

As shown in FIGS. 1A and 1B, the cable-equipped substrate 1 is provided with the cable mounting substrate 10 and plural cables 20 mounted on and connected (soldered) to the cable mounting substrate 10.

Cable Mounting Substrate 10

As shown in FIGS. 2A to 2C, the cable mounting substrate 10 before connecting (soldering) the cables 20 is provided with a plate-shaped base 110 formed of an insulating material, metal ground patterns 120 provided on both surfaces of the base 110, connection pads 130 provided on the both surfaces of the base 110, and first solder members 140 respectively provided on the ground patterns 120.

Cable 20

The cable 20 is provided with a pair of center conductors 210 for transmitting a differential signal, an insulation 220 covering both the center conductors 210, an outer conductor (shield) 230 covering the insulation 220, and an outer cover 240 covering the outer conductor 230. In the first embodiment, the cable 20 has an ellipse cross-sectional shape with a major axis of 2.7 mm and a minor axis of 1.4 mm. A pitch (center-to-center distance) of the pair of center conductors 210 is 0.8 mm.

The center conductor 210 of the cable 20 is a solid wire of a highly conductive metal (e.g., copper) of which surface, if necessary, is plated. A diameter of the center conductor 210 is, e.g., 0.4 mm. The insulation 220 is formed of, e.g., an insulating resin including polyolefin-based resin and fluorine resin, or a foamed insulating resin, etc. In detail, it is possible to use polyethylene as a material of the insulation 220. A melting point of polyethylene is, e.g., about 110° C. The outer conductor 230 is a metal foil tape longitudinally wrapped or spirally (helically) wound around the insulation 220. The metal foil tape is a laminated tape composed of a metal foil such as copper foil or aluminum foil and a plastic tape of polyester, etc., bonded thereto to reinforce the metal foil, and is wound around the insulation 220, with the metal foil facing out. The outer cover 240 is also called "sheath" or "jacket", and is formed using a polyvinyl chloride resin, a polyolefin-based resin or a fluorine resin, etc.

The outer conductor 230 is exposed at an end of the cable 20 by removing the outer cover 240. Then, the center conductors 210 are exposed on the tip side relative to the exposed outer conductor 230 by further removing the outer conductor 230 and the insulation 220.

Base 110

The base 110 is a plate-shaped non-conductor and is formed of, e.g., glass epoxy. The base 110 has a dimension of, e.g., 16 mm in a width direction (the vertical direction of FIG. 2A) and 1 mm in a thickness direction (the vertical direction of FIG. 2B). The connection pads 130 allocated two per cable 20 and the ground pattern 120 to be shared by all cables 20 on the same side are formed on each surface of the base 110. The ground pattern 120 is electrically isolated from the connection pads 130.

The center conductor 210 of the cable 20 is soldered to the corresponding connection pad 130. Meanwhile, the exposed outer conductor 230 of the cable 20 is soldered to the ground pattern 120. In detail, the exposed outer conductor 230 of the cable 20 is electrically connected to the ground pattern 120 by a first solder connection portion 145 which is formed by heating and melting the first solder member 140. The center conductors 210 are electrically connected to the connection pads 130, and the outer conductors 230 are electrically connected to the ground patterns 120.

Ground Pattern 120

The ground pattern 120 is a metal conductor provided on the base 110 and electrically connected to the outer conductors 230. The ground pattern 120 has holes formed in a thickness direction (the vertical direction of FIG. 2B). In the first embodiment, the holes are formed as through-holes 121 which penetrate the ground pattern 120 in the thickness direction and are in communication with the base 110. The holes provided on the ground pattern 120 do not need to penetrate the ground pattern 120.

Connection Pad 130

The connection pad 130 is a meal conductor provided on the base 110 and electrically connected to the center conductor 210.

First Solder Member 140

The first solder member 140 is a member formed of, e.g., an alloy of tin, silver or copper and has a melting temperature of 200° C. to 250° C. The first solder member 140 has recessed portions 141 on a front surface opposite to the surface facing the ground pattern 120. Each recessed portion 141 is formed in a shape along the outer shape of the outer conductor 230 of the cable 20 to be placed thereon. In addition, the recessed portions 141 are formed over the entire length of the first solder member 140 in the longitudinal direction of the cable 20 to be placed (in the horizontal direction of the FIG. 2A). In the first embodiment, the outer shape of the outer conductor 230 is an ellipse shape and the recessed portion 141 is formed in a semi-circular arc shape corresponding to the ellipse shape. It is possible to hold an end of the cable and position the cable 20 by arranging the outer conductor 230 of the cable 20 in the recessed portion 141. In other words, by using the recessed portion 141, it is possible to fix the position the outer conductor 230 relative to the ground pattern 120 before soldering and also the position of the center conductor 210 relative to the connection pad 130 before soldering. Flat surfaces 143 parallel to the surface of the ground pattern 120 on which the first solder member 140 is placed are formed between adjacent recessed portions 141. In the first embodiment, the recessed portion 141 of the first solder member 140 has a depth of 0.3 mm from the flat surface 143. The depth of the recessed portion 141 from the flat surface 143 is preferably not less than 30% of a radius of the placed outer conductor 230 which is a line segment from the center to a periphery in contact with the first solder member 140. In the first embodiment, since the outer conductor 230 is arranged so that a vertex on the minor axis (1.4 mm) is located in the recessed portion 141, the radius of the outer conductor 230 from the periphery in contact with the first solder member 140 is 0.7 mm. Therefore, in the first embodiment, the depth of the recessed portion 141 from the flat surface 143 is preferably not less than 0.21 mm. By adjusting the depth of the recessed portion 141 from the flat surface 143 to not less than 30% of the radius of the placed outer conductor 230 from the periphery in contact with the first solder member 140, it is possible to prevent the cable 20 held in the recessed portion 141 from moving.

The first solder member 140 also has raised portions 142 on a back surface which is the surface facing the ground pattern 120. The raised portions 142 protrude toward a surface of the ground pattern 120 facing the first solder member 140 and extend into the through-holes 121 formed on the ground pattern 120.

The first solder member 140 is tightly adhered to the ground pattern 120. By tightly adhering the first solder member 140 to the ground pattern 120, it is possible to reliably position the plural cables 20 relative to the ground pattern 120 and the connection pads 130.

Method for Forming the First Solder Member 140

Figure 3A:
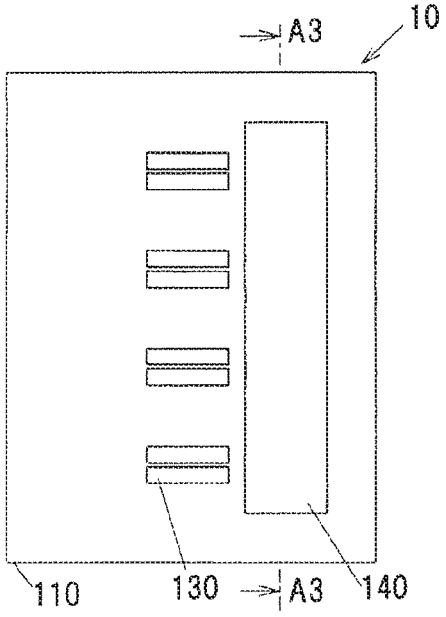
FIG. 3A is a plan view showing the cable mounting substrate before a first solder member is formed into a predetermined shape.
Figure 3B:
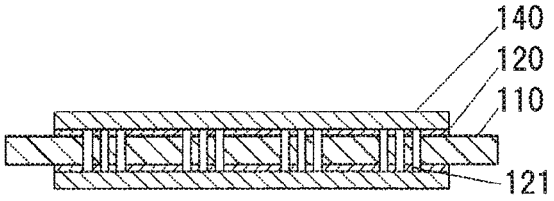
FIG. 3B is a cross sectional view taken along a line A3-A3 in FIG. 3A.
Figure 4:
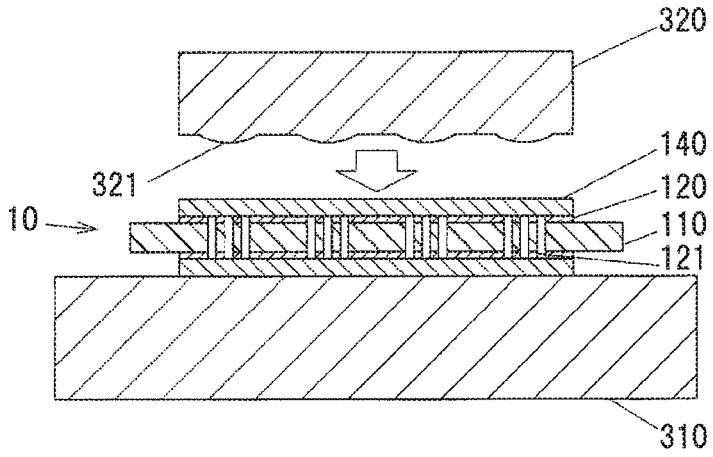
FIG. 4 is a diagram illustrating a method for forming the first solder member into a predetermined shape.

Next, a method for forming the predetermined shaped first solder member 140 on the ground pattern 120 will be described in reference to FIGS. 3A, 3B and 4. FIG. 3A is a plan view showing the cable mounting substrate 10 before the first solder member 140 is formed into a predetermined shape. FIG. 3B is a cross sectional view taken along the line A3-A3 in FIG. 3A. FIG. 4 is a diagram illustrating a method for forming the first solder member 140 into a predetermined shape Firstly, the base 110 having the ground patterns 120 and the connection pads 130 formed thereon as shown in FIGS. 3A and 3B is prepared. The through-holes 121 in communication with the base 110 are formed on the ground patterns 120. The plate-shaped first solder members 140 are provided on the ground patterns 120. The plate-shaped first solder member has a dimension of, e.g., 6 mm in a width direction (the vertical direction of FIG. 3A), 1 mm in a depth direction (the horizontal direction of FIG. 3A), and 0.5 mm in a thickness direction (the vertical direction of FIG. 3B). Next, the cable mounting substrate 10 is placed on a support table 310 so that one surface faces the support table 310, as shown in FIG. 4. A pressing member 320 is brought close to the other surface of the cable mounting substrate 10 opposite to the surface facing the support table 310, and the first solder member 140 is pressed toward the support table 310 by the pressing member 320. The pressing member 320 has plural pressing protrusions 321 on a surface facing the first solder member 140. The pressing protrusion 321 has the same shape as a portion of the outer shape of the outer conductor 230. In the first embodiment, the outer shape of the outer conductor 230 is an ellipse shape and the pressing protrusion 321 is formed in a semi-circular arc shape corresponding to the ellipse shape.

By being pressed by the pressing member 320, the recessed portions 141 having a shape along the outer shape of the outer conductor 230 of the cable 20 are formed on the first solder member 140, as shown in FIG. 2B. Also by being pressed by the pressing member 320, the raised portions 142 partially protruding into the through-holes 121 of the ground pattern 120 are formed on the first solder member 140. Furthermore, adhesin of the first solder member 140 to the ground pattern 120 is increased by being pressed by the pressing member 320.

Then, the cable mounting substrate 10 placed on the support table 310 is flipped over. In other words, the cable mounting substrate 10 is rearranged so that the other surface faces the support table 310. The first solder member 140 on the one surface of the cable mounting substrate 10 is pressed toward the support table 310 by the pressing member 320, and the recessed portions 141 and the raised portions 142 are thereby formed, in the same manner as the first solder member 140 on the other surface.

Soldering Process

Figure 5:
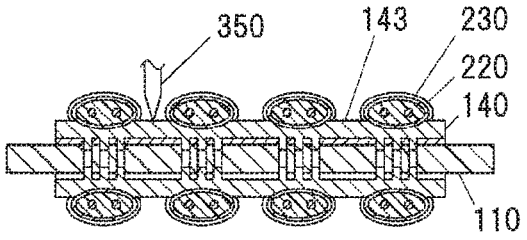
FIG. 5 is an explanatory diagram illustrating how to connect outer conductors to a ground pattern.

Next, a process of connecting the cables 20 to the cable mounting substrate 10 will be described in reference to FIG. 5. FIG. 5 is an explanatory diagram corresponding to a cross section taken along the line A2-A2 in FIG. 2A and illustrating how to connect (solder) the outer conductors 230 to the ground pattern 120.

The process of connecting the cables 20 to the cable mounting substrate 10 includes a step of soldering the outer conductors 230 to the ground patterns 120 and a step of soldering the center conductors 210 to the connection pads 130.

In the step of soldering the outer conductors 230 to the ground patterns 120, a sufficiently-heated tip of a soldering iron 350 is applied to the first solder member 140 (the flat surface 143) between adjacent outer conductors 230, as shown in FIG. 5. The first solder member 140 is melted by heat of the soldering iron 350 and forms the fillet-shaped first solder connection portion 145 between the ground pattern 120 and the outer conductors 230, as shown in FIG. 1B. The ground pattern 120 and the outer conductors 230 are joined and electrically connected by the first solder connection portion 145. By applying the soldering iron 350 to the first solder member 140 (the flat surfaces 143) between all adjacent outer conductors 230, soldering of all the outer conductors 230 to the ground pattern 120 is completed. Meanwhile, the raised portions 142 of the first solder member 140 are melted inside the through-holes 121 when the first solder member 140 is melted, resulting in that the first solder connection portion 145 partially protrudes into the through-holes 121. In the step of soldering the center conductors 210 to the connection pads 130, for example, a wire solder is melted by the soldering iron at a portion where the center conductor 210 is joined to the connection pad 130. The molten solder forms a fillet shape between the connection pad 130 and the center conductor 210, and the connection pad 130 is thereby joined and electrically connected to the center conductor 210.

Through the steps described above, the cable mounting substrate 10 and the cables 20 are connected to each other and form the cable-equipped substrate 1.

Effects of the First Embodiment

In the first embodiment, the recessed portions 141 having a shape along the outer shape of the outer conductor 230 to be placed are formed on the first solder member 140. In the cable mounting substrate 10, since the recessed portions 141 are formed on the first solder member 140, it is possible to fix the positions of the outer conductors 230 relative to the ground pattern 120 before soldering and the positions of the center conductors 210 relative to the connection pad 130 before soldering. Therefore, it is possible to easily and reliably connect plural cables 20 to the cable mounting substrate 10.

In addition, the first solder member 140 is provided with the raised portions 142 protruding into the through-holes 121 formed on the ground pattern 120. In the cable mounting substrate 10, movement of the first solder member 140 relative to the ground pattern 120 can be prevented by the raised portions 142 formed on the first solder member 140. Therefore, it is possible to connect the plural cables 20 to the cable mounting substrate 10 more easily and reliably.

In addition, after connecting the outer conductors 230 to the ground pattern 120, connection between the ground pattern 120 and the outer conductors 230 is reinforced since the first solder connection portion 145 connecting the outer conductors 230 to the ground pattern 120 partially protrudes into the through-holes 121.

Second Embodiment

Figure 6A:
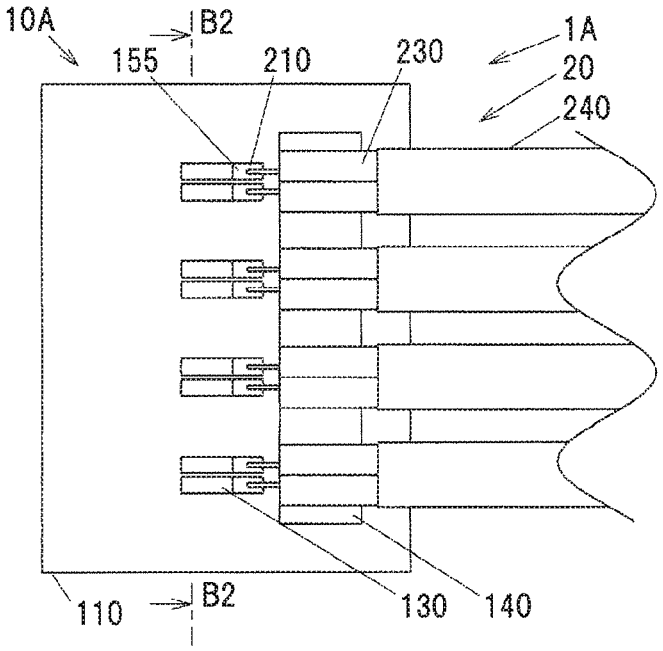
FIG. 6A is a plan view showing a cable-equipped substrate in the second embodiment of the invention.
Figure 6B:
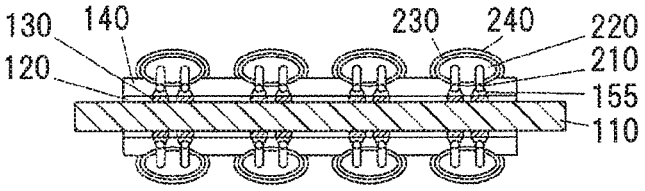
FIG. 6B is a cross sectional view taken along a line B2-B2 in FIG. 6A.
Figure 7A:
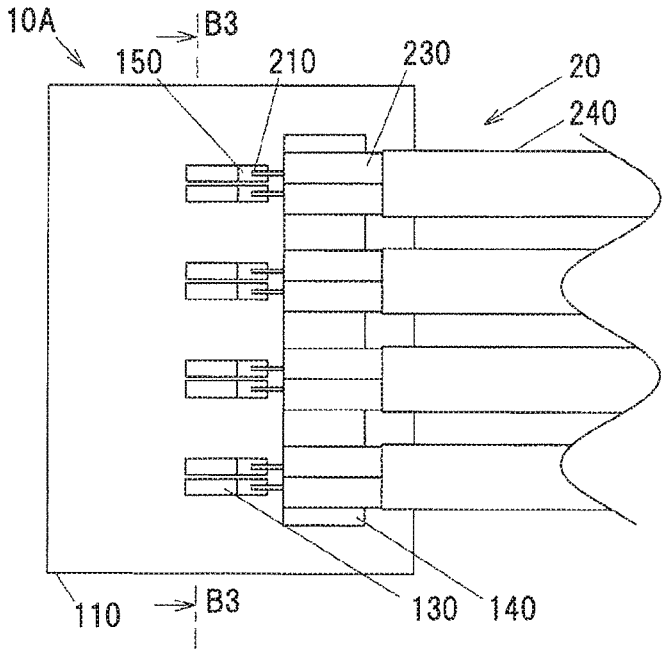
FIG. 7A is a plan view showing a cable mounting substrate before the cables are connected.
Figure 7B:
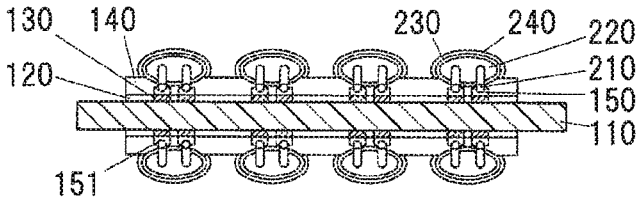
FIG. 7B is a cross sectional view taken along a line B3-B3 in FIG. 7A.

Next, the second embodiment of the invention will be described in reference to FIGS. 6A, 6B, 7A and 7B. FIG. 6A is a plan view showing a cable-equipped substrate 1A in the second embodiment of the invention. FIG. 6B is a cross sectional view taken along the line B2-B2 in FIG. 6A. FIG. 7A is a plan view showing a cable mounting substrate 10A before the cables 20 are connected. FIG. 7B is a cross sectional view taken along the line B3-B3 in FIG. 7A.

The cable-equipped substrate 1A (the cable mounting substrate 10A) of the second embodiment is different from the cable-equipped substrate 1 (the cable mounting substrate 10) of the first embodiment in a method for connecting (soldering) the center conductor 210 to the connection pad 130. Therefore, in the following description, the connected portion between the connection pad 130 and the center conductor 210 will be described. The same constituent elements as those of the cable-equipped substrate 1 in the first embodiment are denoted by the same reference numerals, and the explanation thereof will be omitted. The cable-equipped substrate 1A (the cable mounting substrate 10A) of the second embodiment has second solder members 150 provided on the connection pads 130.

Second Solder Member 150

The second solder member 150 is a member formed of, e.g., an alloy of tin, silver or copper and has a melting temperature of 200° C. to 250° C. The second solder member 150 is formed of the same material as the first solder member 140. Each second solder member 150 has a recessed portion 151 on a surface opposite to the surface facing the connection pad 130. The recessed portion 151 is formed in a shape along the outer shape of the center conductor 210 of the cable 20 to be placed thereon. In the second embodiment, the outer shape of the center conductor 210 is a substantially circular shape and the recessed portion 151 is formed in a semi-circular arc shape corresponding to the substantially circular shape. It is possible to position the cable 20 by arranging the center conductor 210 of the cable 20 in the recessed portion 151.

The second solder member 150 is tightly adhered to the connection pad 130. By tightly adhering the second solder member 150 to the connection pad 130, it is possible to reliably position the center conductor 210 relative to the connection pad 130.

Method for Forming the Second Solder Member 150

Figure 8A:
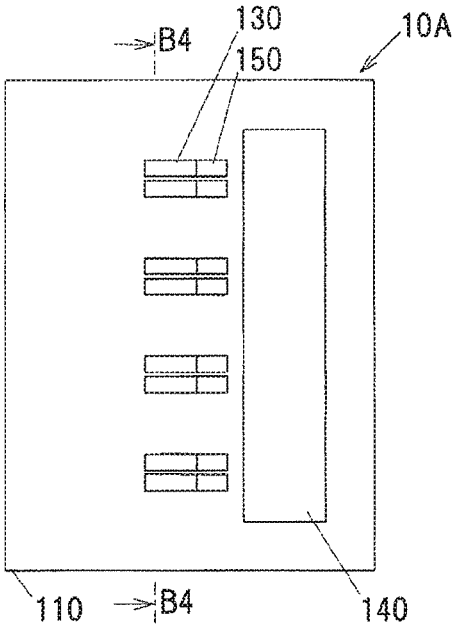
FIG. 8A is a plan view showing the cable mounting substrate before second solder members are formed into a predetermined shape.
Figure 8B:
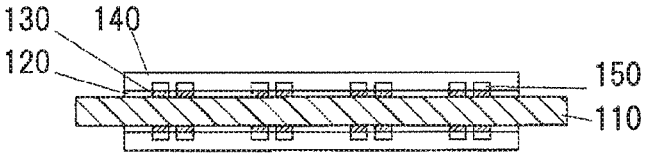
FIG. 8B is a cross sectional view taken along a line B4-B4 in FIG. 8A.
Figure 9:
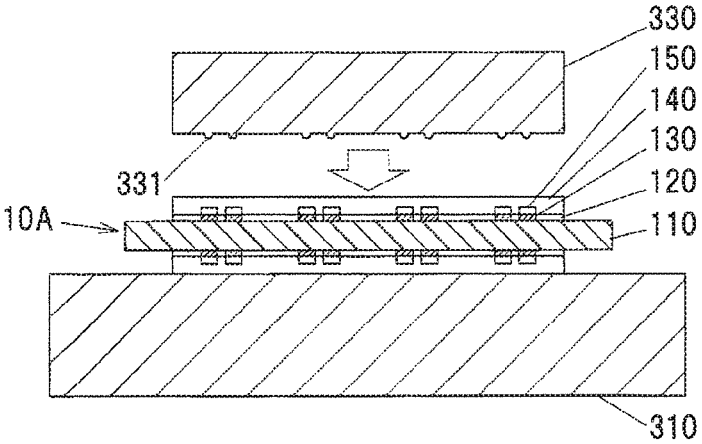
FIG. 9 is a diagram illustrating a method for forming the second solder members into a predetermined shape.

Next, a method for forming the predetermined shaped second solder members 150 on the connection pads 130 will be described in reference to FIGS. 8A, 8B and 9. FIG. 8A is a plan view showing the cable mounting substrate 10A before the second solder members 150 are formed into a predetermined shape. FIG. 8B is a cross sectional view taken along the line B4-B4 in FIG. 8A. FIG. 9 is a diagram illustrating a method for forming the second solder members 150 into a predetermined shape.

Firstly, the base 110 having the ground patterns 120 and the connection pads 130 preliminarily formed thereon as shown in FIGS. 8A and 8B is prepared. The plate-shaped first solder members 140 are provided on the ground patterns 120. The plate-shaped second solder members 150 are provided on the connection pads 130. Since the method for forming the first solder member 140 into a predetermined shape is the same as that in the first embodiment, the explanation thereof will be omitted.

Next, the cable mounting substrate 10A is placed on the support table 310 so that one surface faces the support table 310, as shown in FIG. 9. A pressing member 330 is brought close to the other surface of the cable mounting substrate 10A opposite to the surface facing the support table 310, and the second solder members 150 are pressed toward the support table 310 by the pressing member 330. The pressing member 330 has plural pressing protrusions 331 on a surface facing the second solder members 150. The pressing protrusion 331 has the same shape as a portion of the outer shape of the center conductor 210. In the second embodiment, the outer shape of the center conductor 210 is a substantially circular shape and the pressing protrusion 331 is formed in a semi-circular arc shape corresponding to the substantially circular shape.

By being pressed by the pressing member 330, the recessed portions 151 having a shape along the outer shape of the center conductor 210 of the cable 20 are formed on the second solder members 150, as shown in FIG. 7B. In addition, adhesin of the second solder members 150 to the connection pads 130 is increased by being pressed by the pressing member 330.

Then, the cable mounting substrate 10A placed on the support table 310 is flipped over. In other words, the cable mounting substrate 10A is rearranged so that the other surface faces the support table 310. The second solder members 150 on the one surface of the cable mounting substrate 10A are pressed toward the support table 310 by the pressing member 330, and the recessed portions 151 are thereby formed, in the same manner as the second solder members 150 on the other surface.

The pressing member 320 and the pressing member 330 are described as separate members denoted by different reference numerals, but may be integrated into one member. In this case, the recessed portions 141 and the raised portions 142 of the first solder member 140 are formed simultaneously with the recessed portions 151 of the second solder members 150.

Soldering Process

Next, a process of connecting the cables 20 to the cable mounting substrate 10A will be described. The process of connecting the cables 20 to the cable mounting substrate 10A includes a step of soldering the outer conductors 230 to the ground patterns 120 and a step of soldering the center conductors 210 to the connection pads 130. Since the step of soldering the outer conductors 230 to the ground patterns 120 is the same as that in the first embodiment, the explanation thereof will be omitted.

In the step of soldering the center conductors 210 to the connection pads 130, a sufficiently-heated tip of a soldering iron is applied to each second solder member 150 between adjacent center conductors 210. The second solder member 150 is melted by heat of the soldering iron and forms a fillet-shaped second solder connection portion 155 between the connection pad 130 and the center conductor 210 as shown in FIG. 6. The connection pad 130 and the center conductor 210 are joined and electrically connected by the second solder member 150.

Effects of the Second Embodiment

The cable-equipped substrate 1A and the cable mounting substrate 10A in the second embodiment have the same effects as the first embodiment. In addition, in the second embodiment, the second solder member 150 is provided with the recessed portion having a shape along the outer shape of the center conductor 210 of the cable 20 to be placed. It is possible to position the cable 20 by arranging the center conductor 210 of the cable 20 in the recessed portion 151. Therefore, it is possible to connect the plural cables 20 to the cable mounting substrate 10A more easily and reliably.

Third Embodiment

Figure 10A:
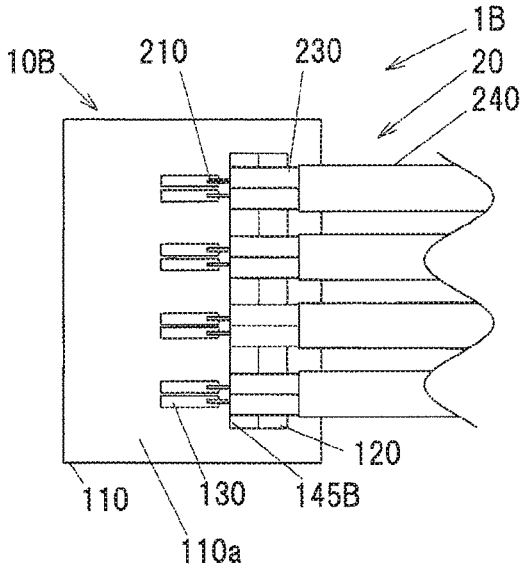
FIG. 10A is a plan view showing a cable-equipped substrate in the third embodiment of the invention when viewing from the front side of a base.
Figure 10B:
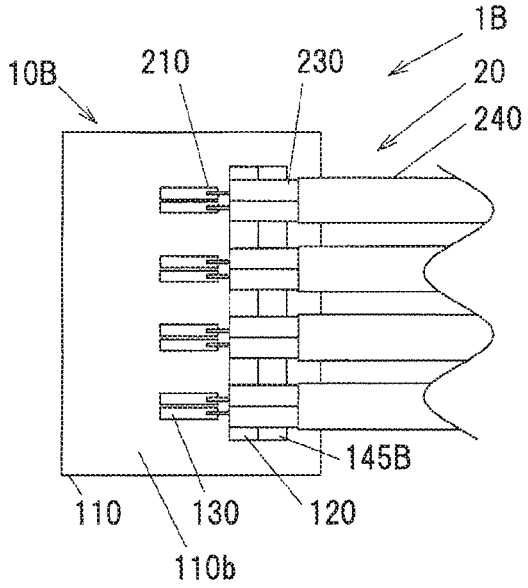
FIG. 10B is a plan view showing the cable-equipped substrate when viewing from the back side of the base.
Figure 11A:
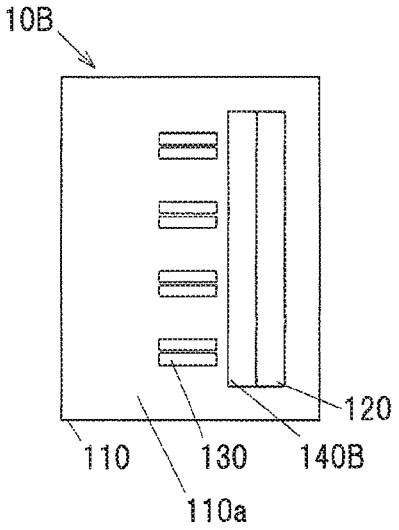
FIG. 11A is a plan view showing a cable mounting substrate in the third embodiment of the invention when viewing from the front side of the base.
Figure 11B:
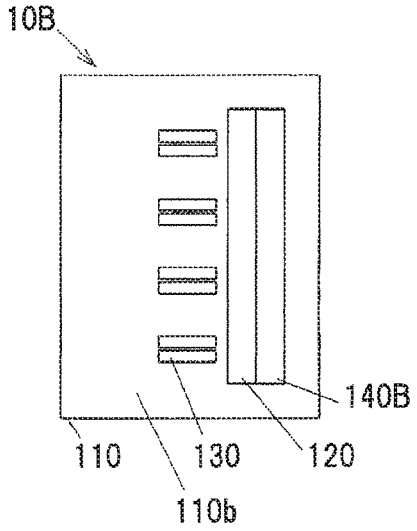
FIG. 11B is a plan view showing the cable mounting substrate when viewing from the back side of the base.

Next, the third embodiment of the invention will be described in reference to FIGS. 10A, 10B, 11A and 11B. FIG. 10A is a plan view showing a cable-equipped substrate 1B in the third embodiment of the invention when viewing from a front surface 110*a* (one side) of the base 110. FIG. 10B is a plan view showing the cable-equipped substrate 1B when viewing from a back surface 110*b* (the other side) of the base 110. FIG. 11A is a plan view showing a cable mounting substrate 10B in the third embodiment of the invention when viewing from the front surface 110*a* (one side) of the base 110. FIG. 11B is a plan view showing the cable mounting substrate 10B when viewing from the back surface 110*b* (the other side) of the base 110.

The cable-equipped substrate 1B (the cable mounting substrate 10B) of the third embodiment is different from the cable-equipped substrate 1 (the cable mounting substrate 10) of the first embodiment in positions at which the first solder connection portions (the first solder members) are provided. Therefore, in the following description, first solder connection portions 145B (first solder members 140B) will be described. The same constituent elements as those of the cable-equipped substrate 1 in the first embodiment are denoted by the same reference numerals, and the explanation thereof will be omitted.

In the cable mounting substrate 10B of the third embodiment, the position of the first solder member 140B relative to the ground pattern 120 is different between on the front surface 110*a* (one side) and the back surface 110*b* (the other side) of the base 110. On the front surface 110*a* (one side) of the base 110, the first solder member 140B is provided on a portion of the ground pattern 120 on the front tip side of the cable 20 (on the connection pad 130 side) and is not provided on a portion of the ground pattern 120 on the rear end side of the cable 20 (on the opposite side to the connection pad 130), as shown in FIG. 11A. In other words, a portion of the ground pattern 120 on the rear end side of the cable 20 (on the opposite side to the connection pad 130) is exposed on the front surface 110*a* side of the base 110. On the back surface 110*b* (the other side) of the base 110, the first solder member 140B is provided on a portion of the ground pattern 120 on the rear end side of the cable 20 (on the opposite side to the connection pad 130) and is not provided on a portion of the ground pattern 120 on the front tip side of the cable 20 (on the connection pad 130 side), as shown in FIG. 11B. In other words, a portion of the ground pattern 120 on the front tip side of the cable 20 (on the connection pad 130 side) is exposed on the back surface 110*b* side of the base 110. That is, the first solder member 140B on the front surface 110*a* side of the base 110 and that on the back surface 110*b* side are misaligned in the longitudinal direction of the cable 20. The first solder members 140B provided on the front surface 110*a* side and the back surface 110*b* side are completely misaligned in the longitudinal direction of the cable 20 in the third embodiment, but may partially overlap.

Each first solder member 140B has recessed portions having a shape along the outer shape of the outer conductor 230 to be placed and raised portions protruding into the through-holes 121 in the same manner as the first embodiment. The raised portions on the front surface 110*a* side of the base 110 and those on the back surface 110*b* side are misaligned in the longitudinal direction of the cable 20. Since the raised portions on the front surface 110*a* side of the base 110 are misaligned with those on the back surface 110*b* side, the through-holes 121 into which the raised portions on the front surface 110*a* side protrude are different from the through-holes 121 into which the raised portions on the back surface 110*b* side protrude. Since the raised portions on the front surface 110*a* side of the base 110 and those on the back surface side of the base 110 protrude into different through-holes 121, the first solder members 140B can be firmly held on the ground patterns 120. Likewise, the recessed portions on the front surface 110*a* side of the base 110 and those on the back surface 110*b* are also misaligned in the longitudinal direction of the cable 20.

When manufacturing the cable-equipped substrate 1B in the third embodiment of the invention, the first solder member 140B is melted by heat of a soldering iron and forms the fillet-shaped first solder connection portion 145B between the ground pattern 120 and the outer conductors 230, in the same manner as the first embodiment. Alternatively, to form the fillet-shaped first solder connection portion 145B between the ground pattern 120 and the outer conductors 230, the first solder member 140B may be indirectly heated and melted by heat of the soldering iron applied to the externally exposed ground pattern 120. The ground pattern 120 and the outer conductors 230 are joined and electrically connected by the first solder connection portion 145B.

As shown in FIGS. 10A and 10B, the first solder connection portion 145B on the front surface 110*a* side of the base 110 and that on the back surface 110*b* side are misaligned in the longitudinal direction of the cable 20. The first solder connection portions 145B provided on the front surface 110*a* side and the back surface 110*b* side are completely misaligned in the longitudinal direction of the cable 20 in the third embodiment, but may partially overlap. The raised portions of the first solder member 140B are melted inside the through-holes 121 when the first solder member 140B is melted, resulting in that the first solder connection portion 145B partially protrudes into the through-holes 121. The portions of the first solder connection portion 145B protruding into the through-holes 121 on the front surface 110*a* side of the base 110 and the portions of the first solder connection portion 145B protruding into the through-holes 121 on the back surface 110*b* side are misaligned in the longitudinal direction of the cable 20. Since the protruding portions of the first solder connection portion 145B protrude into different through-holes 121 on the front side and the back side, connection between the outer conductors 230 and the ground patterns 120 is reinforced.

Effects of the Third Embodiment

The cable-equipped substrate 1B and the cable mounting substrate 10B in the third embodiment have the same effects as the first embodiment. In addition, since the raised portions of the first solder members 140B on the front surface 110*a* side of the base 110 and those of the first solder members 140B on the back surface side of the base 110 protrude into different through-holes 121, the first solder members 140B can be firmly held on the ground patterns 120.

In addition, since the protruding portions of the first solder connection portion 145B protrude into different through-holes 121 on the front side and the back side, connection between the outer conductors 230 and the ground patterns 120 is reinforced.

Although the embodiments of the invention have been described above, the invention according to claims is not to be limited to the above-mentioned embodiments. Further, please note that all combinations of the features described in the embodiments are not necessary to solve the problem of the invention.

For example, although an example in which plural cables are connected on both surfaces of the cable mounting substrate has been described, plural cable may be connected to only one surface of the cable mounting substrate. In this case, the ground pattern, the connection pads, the first solder member and the second solder members are provided only on one surface of the substrate.

For example, although the cable having an ellipse cross-sectional shape has been described as an example, the cable may be a round coaxial cable, etc. When the cable has a circular cross-sectional shape, the recessed portions on the first solder member are formed in a corresponding semi-circular arc shape.

For example, although an example of placing the outer conductor so that a vertex on the minor axis is located in the recessed portion has been described, the outer conductor may be placed so that a vertex on the major axis is located in the recessed portion.

What is claimed is:

1. A cable mounting substrate for mounting a plurality of cables each of which comprises a center conductor, an insulation covering the center conductor and an outer conductor covering the insulation, the cable mounting substrate comprising:

a plate-shaped base;

a ground pattern that is arranged on the base and electrically connected to the outer conductor; and a solder member that is provided on the ground pattern and is melted to electrically connect and fix the outer conductor to the ground pattern, wherein the solder member comprises a recessed portion having a shape along an outer shape of the outer conductor, wherein the ground pattern comprises a hole formed in a thickness direction, and wherein the solder member comprises a raised portion protruding into the hole.

2. The cable mounting substrate according to claim 1, wherein the solder member adheres tightly to the ground pattern.

3. A cable mounting substrate for mounting a plurality of cables each of which comprises a center conductor, an insulation covering the center conductor and an outer conductor covering the insulation, the cable mounting substrate comprising:

a plate-shaped base;

a ground pattern that is arranged on the base and electrically connected to the outer conductor; and a solder member that is provided on the ground pattern and is melted to electrically connect and fix the outer conductor to the ground pattern, wherein the solder member comprises a recessed portion having a shape along an outer shape of the outer conductor, wherein the ground pattern and the solder member are provided on both surfaces of the base, and wherein the solder member on one surface of the base are not aligned with the solder member on an other surface of the base in a longitudinal direction of the cable.

4. The cable mounting substrate according to claim 3, wherein the solder member adheres tightly to the ground pattern.

5. A cable-equipped substrate, comprising:

a plurality of cables each comprising a center conductor, an insulation covering the center conductor and an outer conductor covering the insulation; and a cable mounting substrate that mounts the plurality of cables, wherein the cable mounting substrate comprises:

a base comprising an insulating material;

a metal ground pattern provided on the base and electrically connected to the outer conductors; and a solder connection portion connecting the ground pattern to the outer conductors, wherein the ground pattern comprises a hole formed in a thickness direction, and the solder connection portion protrudes into the hole.

6. A method for connecting cables to a cable mounting substrate in such a manner that a plurality of cables, each comprising a center conductor, an insulation covering the center conductor and an outer conductor covering the insulation, are mounted on the cable mounting substrate, the method comprising:

preparing the cable mounting substrate; and mounting the cables on the cable mounting substrate, wherein the preparing comprises forming a metal ground pattern to be connected to the outer conductors on a base comprising an insulating material, mounting a plate-shaped solder member on the ground pattern, and pressing the solder member against the ground pattern so that the solder member is tightly adhered to the ground pattern and a recessed portion having a shape along an outer shape of the outer conductor is formed on a surface of the solder member, and wherein the mounting comprises arranging the cables so that the outer conductor is put in the recessed portion, and connecting the outer conductor to the ground pattern by heating and melting the solder member.

7. The method according to claim 6, wherein the forming of the metal ground pattern comprises forming a hole formed in a thickness direction on the ground pattern, and wherein a raised portion protruding into the hole is formed on the solder member by the pressing.

* * * * *